US005787753A

United States Patent [19]

Dougherty

[11] Patent Number: 5,787,753

[45] Date of Patent: Aug. 4, 1998

[54] APPARATUS AND METHOD FOR FORGING A PINION GEAR WITH A NEAR NET SHAPE

[75] Inventor: Michael C. Dougherty, Navarre, Ohio

[73] Assignee: Colfor Manufacturing, Inc., Malvern, Ohio

[21] Appl. No.: 742,063

[22] Filed: Oct. 31, 1996

(Under 37 CFR 1.47)

Related U.S. Application Data

[63] Continuation-in-part of Ser. No. 550,708, Oct. 31, 1995.

[51] Int. Cl.[6] ..... B21D 22/00

[52] U.S. Cl. ..... 72/352; 29/893.34; 72/361

[58] Field of Search ..... 72/344, 345, 352, 72/356, 357, 360, 361, 377, 419, 427; 29/893.34; 470/16, 191

[56] References Cited

U.S. PATENT DOCUMENTS

| | | | |
|---|---|---|---|
| 3,355,930 | 12/1967 | Fedorov . | |
| 3,370,450 | 2/1968 | Scheucher . | |
| 3,429,172 | 2/1969 | Lierse et al. | 72/361 |
| 3,731,516 | 5/1973 | Dohmann et al. . | |
| 3,832,763 | 9/1974 | Schober . | |
| 4,050,283 | 9/1977 | Schober . | |
| 4,074,559 | 2/1978 | Beane et al. . | |
| 4,389,871 | 6/1983 | Takeuchi et al. . | |
| 4,433,568 | 2/1984 | Kondo . | |
| 4,468,827 | 9/1984 | Shachaf . | |
| 4,574,609 | 3/1986 | Berecz . | |
| 4,590,782 | 5/1986 | Leykamm et al. . | |
| 4,672,729 | 6/1987 | Hoguchi et al. . | |
| 4,700,446 | 10/1987 | Schmid et al. . | |
| 4,856,167 | 8/1989 | Sabroff et al. . | |
| 5,274,921 | 1/1994 | Kawagoe et al. . | |
| 5,363,714 | 11/1994 | Hoguchi . | |
| 5,396,789 | 3/1995 | Castellon . | |

FOREIGN PATENT DOCUMENTS

| | | | |
|---|---|---|---|
| 1-254340 (A) | 10/1989 | Japan | 72/352 |

*Primary Examiner*—Joseph J. Hail, III
*Assistant Examiner*—Rodney Butler
*Attorney, Agent, or Firm*—Dinsmore & Shohl LLP

[57] ABSTRACT

A die apparatus and method for forging a workpiece into a near net shaped gear, and includes a first die having a tooth die with a near net shaped negative cavity configured therein to forge the near net shaped gear. Also, the apparatus includes an axial restriction member that sufficiently reduces axial movement of the forged gear as tooth die moves away from the first die relative to the second die. This axial resistance member enables the head portion of the gear to be removed from the first die, and more specifically, the tooth die, after the forging portion of stroke is completed.

23 Claims, 4 Drawing Sheets

APPARATUS AND METHOD FOR FORGING A PINION GEAR WITH A NEAR NET SHAPE

REFERENCE TO COPENDING APPLICATION

This is a continuation-in-part application of prior copending application Ser. No. 08/550,708 filed Oct. 31, 1995.

TECHNICAL FIELD OF THE PRESENT INVENTION

The present invention relates to an apparatus and method for producing pinion gears, and more specifically, an apparatus and method for producing a near net shaped head portion of pinion gears using the forging operation, and without the need to machine separately the teeth and groove arrangement.

BACKGROUND OF THE PRESENT INVENTION

Pinion gears for use in automobiles and trucks have typically been manufactured according to a multi-step process involving forging, turning, rough cutting and finishing. A solid workpiece typically is forged into its general overall shape, as shown in FIG. 1, (e.g., 15) which is a blank having a simple frusto-conical shaped head portion without teeth or corresponding grooves. To provide a tooth arrangement or configuration in the head portion of the gear, the blank is turned on a lathe, and grooves are rough cut in the head portion of the forged workpiece to the desired depth and at the desired angle on specialized gear cutting equipment. In certain processes, as many as three (3) separate insert cuts are made to provide the desired tooth arrangement or configuration, such as the first and second face (e.g., drive and coast face) of the tooth, as well as the root of the grooved head portion to provide the geometry required for a pinion gear. These prior methods have not been totally satisfactory as the solid workpiece is much greater in volume before forging than the finished pinion gear, which requires undesirable higher material and heating costs. Furthermore, machine cutting of teeth arrangements is an expensive and time-consuming operation.

Previously, near net shaped forging has been available for spiral bevel gears forged from powdered material, for example, as described in the disclosure of U.S. Pat. No. 4,050,283 (Schober). A gear manufactured in accordance with the teachings of this reference is significantly different from a gear forged from a solid hardstock workpiece. Typically, a gear forged using this process is manufactured from a nonsolid metal powder and wax binder that is first poured into a die and compacted to create a briquet, that is then sintered to melt out the wax and provide a metallurgical bond between the individual powdered particles. A gear produced in accordance with this method only has about 80% density compared with that of a billet forged gear from a solid workpiece, which significantly reduces the strength of the gear, and as such, limits use to nonheavy duty applications, such as home appliance or garden and lawn equipment (e.g., garden tractors). Forging of a nonsolid powdered material does not provide the desired material grain flow into the gear teeth and thus, the part is not as structurally sound as a gear forged from a solid hardstock billet.

There has been a need in the industry to provide an apparatus and method by which workpiece material can be conserved and a near net shaped pinion gear, and preferably a differential stem pinion gear, can be manufactured or formed using a forging operation that greatly reduces the removal of stock material without the subsequent steps of full depth machining the individual grooves to provide the desired tooth arrangement. Such a demand has not previously been realized due to technical difficulties of forging the tooth configuration of a pinion gear, and then removing the head portion of a pinion gear from the die once forged without damaging the tooth arrangement.

SUMMARY OF THE INVENTION

It is the object of the present invention to provide a pinion gear manufactured in a near net shaped without the need for full depth rough machining the tooth arrangement.

Another object of the present invention is to provide a near net shaped pinion gear utilizing preexisting press machines.

Still another object of the present invention is to reduce the material and energy costs of manufacturing a pinion gear.

Yet another object of the present invention is to provide a pinion gear forged with high precision by compressive forces.

It is another object of the present invention to provide an apparatus and method for manufacturing a near net shaped pinion gear that addresses and overcomes the above-mentioned shortcomings in the forging industry.

Additional objects, advantages, and other features of the present invention will be set forth and will become apparent to those skilled in the industry upon examination of the following, or may be learned with practice of the invention. To achieve the foregoing and other objects, and in accordance with the purpose herein, the present invention comprises a press machine or die apparatus for forging the near net shaped head portion of a pinion gear from a solid workpiece, and includes a first or upper die having a negative cavity corresponding to the near net shaped head portion for forging the head portion. Also, the apparatus includes an axial restriction member configured for assisting in removing the forged gear from the negative cavity after forging.

In one embodiment, the axial restriction member can be provided in a second or lower die, and the interior surface of the stem die and the surface of the stem portion are configured to provide sufficient resistance and/or surface friction to assist in restricting substantial axial movement of the forged gear while permitting the forged gear to rotate so that the forged head portion releases itself from negative cavity of the first or upper die. A holding band, such as one or more depressions, preferably can be provided in the interior surface of the stem die, and material can be forced or "sweated" into the depression to form a stem protrusion on the surface of the stem portion as the head portion is being forged. The depression can extend either around the entire periphery of the interior surface, or a selected portion, as desired. The resulting stem protrusion having a depth into the stem die from about 0.01 to about 0.02 inches can provide sufficient resistance and/or surface friction to assist in restricting or preventing substantial axial movement of the gear, yet allows rotational or radial movement of the gear to assist or help in removing the forged head portion from the negative cavity.

In another embodiment where the axial restriction member can be positioned or provided in the first or upper die. A tooth cavity can have a bore hole and a slidably receivable pin can be selectively extendable through the bore hole for maintaining engagement against the forged head portion as the tooth cavity of the first or upper die moves away relative to the second or lower die, thus preventing substantial axial movement while allowing rotational or radial movement of the forged gear to assist in removing the forged gear from the negative cavity.

In use, a press machine or die apparatus can be provided for forging the head portion of a solid workpiece into the near net shaped configuration. While the head portion is being forged, an axial restriction member can be formed on the stem portion of the forged gear. To remove the forged head portion from the press machine without nicking or damaging the forged head portion, axial movement of the forged gear is restricted while radial or rotational movement of the forged gear is permitted. In one embodiment, resistance and/or surface between the stem portion of the forged gear and the interior surface of the stem die substantially restricts axial movement while permitting rotational or radial movement. When a stem protrusion is provided or formed on the stem portion, it preferably can be removed from the stem portion as it is being ejected or otherwise suitably removed from the stem die.

In another embodiment, the press machine or die apparatus includes a first die including a tooth die having a bore hole and a pin selectively slideably extendable through the bore hole for engaging against the head portion. After forging is completed, the tooth die moves away from the forged gear relative to the second die, while the pin remains in contact with or engaged with the head portion for restricting or otherwise preventing axial motion or movement of the forged gear while permitted radial movement.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DISCUSSION OF THE INVENTION

Figure 2:
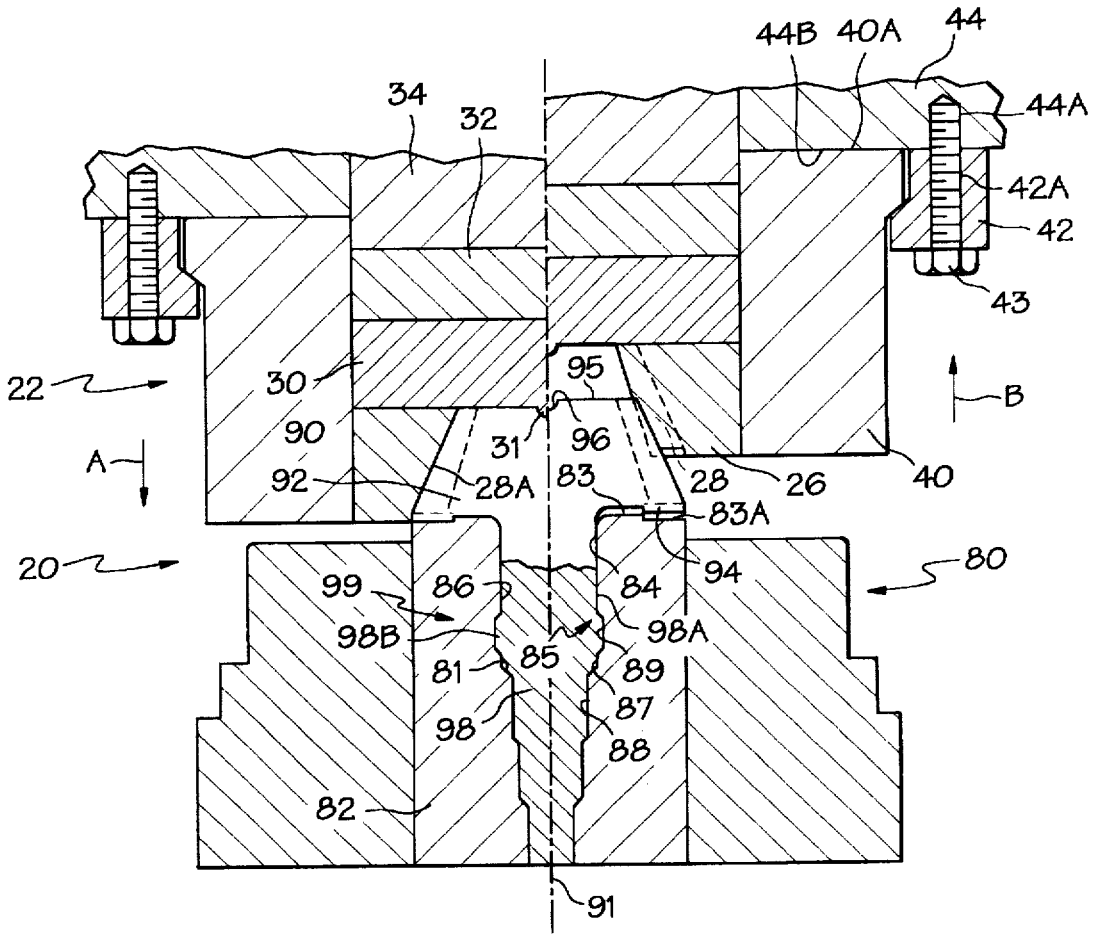
FIG. 2 is a partial cross-sectional view of a press machine incorporating one embodiment of the apparatus and method of the present invention wherein the left side illustrates the press machine in a closed position and the right side illustrates the press machine in an open position.

Referring now to the drawing figures in detail wherein like numerals indicate the same element throughout the views, FIG. 2 is generally representative of die apparatus or press machine indicated as numeral 20, which can include any type of press machine or die apparatus known in the industry used in forging operations such as a mechanical, steam, air, or hydraulic press capable of applying a sufficient amount of force (e.g., approximately from about 500 to about 3000 tons or from about $4.5 \cdot 10^6$N to about $2.7 \cdot 10^7$N) on a workpiece in a single stroke, depending on the part size. Die apparatus 20 includes an upper or first die 22 and a lower or second die 80, which in the present invention are used together in a closed die forging operation. First die 22 features a tooth die 26, exemplified in FIG. 2, that may be centered on center axis 91 and may have a plurality of teeth segments 28 and a negative cavity 27 (also see FIG. 3) that can forge the desired near net shaped of the head portion 92 of a gear 90, such as a pinion gear, and preferably, a differential stem pinion gear having a tooth configuration that can be helically spiraling, and can include a plurality of teeth (e.g., 93) that are parallel to each other.

A stencil die 30 is exemplified as positioned above the tooth die 26 and may be also centered on center axis 91 to assist in forging the top surface 95 on the head portion 92 of the gear 90 with various indicia, such as alpha/numeric information or designs. Preferably, a drive lug or male center 31 can be centered on stencil die 30 to enable the forging of a notch or female center 96 that may be centered in the head portion 92. A notch or female center 96 can be used in later machine operations, or with the present invention to assist in the removal of the head portion (e.g., 192) from tooth die (e.g., 126), as will be discussed in greater detail.

A centered backing die 32 can be positioned above stencil die 30 that can assist the stencil die 30 in forging the top surface 95 of the head portion 92 with the female center 96 and/or any desired indicia. The first die 22 can also be provided with a pilot 34 fixed along the center axis 91 that generally centers the upper tooling (e.g., stencil die 30, backing die 32, and tooth die 26) in a die holder 40. Die holder 40 can be a ring shaped support that substantially surrounds tooth die 26, stencil die 30, and backing die 32, and assists in rigidly fixing or securing these elements in the desired orientation or position. One or more die caps 42 can be used to hold the die holder 40 in place, and may be rigidly mounted to a die shoe 44 by inserting a connecter, such as a screw or bolt 43 for example, through bore hole 42A in the die cap 42 and into a bore hole 44A in the die shoe 44. The top surface 40A of die holder 40 should be substantially flush against the bottom surface 44B of the die shoe 44 so that tooth die 26, stencil die 30, backing die 32 and pilot 34 remain rigidly fixed in place and preferably cannot rotate or otherwise move relative to each other during the forging stroke, which is exemplified by arrow "A." Other assemblies and techniques known in the industry for centering and/or fixing or securing the upper tooling (e.g., the stencil die 30, the backing die 32, and the tooth die 26) can be used with the present invention, as desired.

Tooth die 26 and stencil die 30 preferably are removable, and can be replaced with another tooth die (e.g., 26) or a stencil die (e.g., 30) having a different tooth configuration and pitch, indicia, or the absence of the male center 31. The flexibility to interchange tooth die and stencil die (e.g., 26 and 30) enables gears of different sizes, shapes, and pitches to be forged on the same die apparatus 20 in a simple and economical manner.

Figure 1:
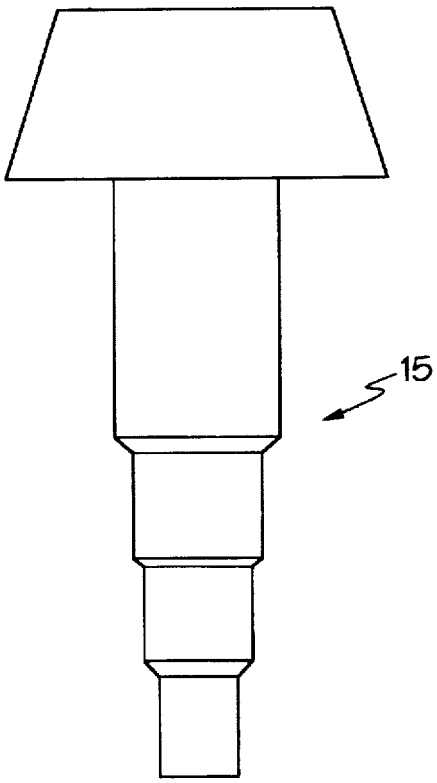
FIG. 1 PRIOR ART
FIG. 1 is perspective view of a prior art forged pinion gear.
Figure 6:
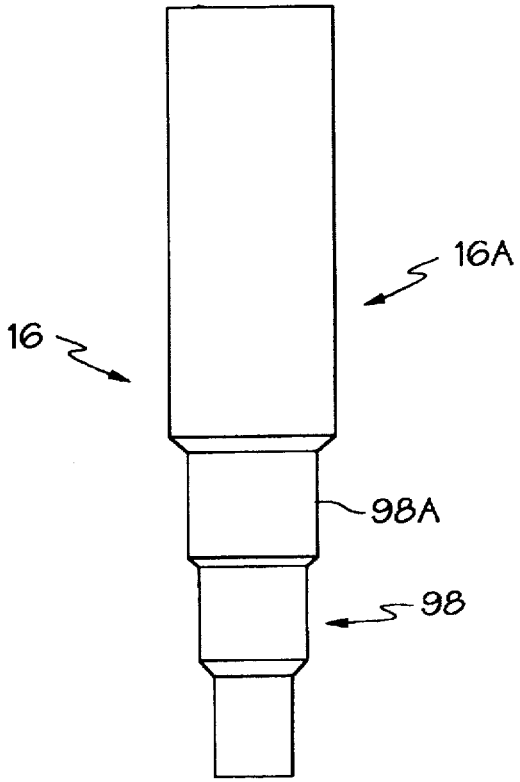
FIG. 6 is a perspective view of a billet having a stem portion that has been forged and a head portion that has not been forged.

Second die 80 is exemplified as including a stem die 82 having a stem cavity 84 that is configured to receive the stem portion 98 of a preform 16, as exemplified in FIG. 6. Although the following discussion contemplates that the stem portion 98 is forged before the head portion 92, the present invention also contemplates that the head portion 92 can be forged before or prior to the stem portion 98.

The stem die 82 is configured to permit selective movement of the stem portion 98 for assisting in removing the head portion 92 from the tooth die 26 during the retraction stroke, or as first die 22 moves away from the head portion 92 as exemplified by arrow "B" in FIG. 2. The stem die 82 can have a plurality of section with various diameters as exemplified by a first portion 86, a second portion 87, and a third portion 88 of interior surface 85 in FIG. 2, each having a different effective diameter that is generally configured to correspond to the shape and assist in supporting the stem portion 98 of the preform 16, and for assisting in adjusting in the pressure that can be applied to the stem portion 98. Typically, the diameter change region or transition area 81 between the portions (e.g., between first portion 86 and second portion 87) is rather sudden or pronounced (i.e., not gradual) and is also configured and adapted to accommodate or hold the already or previously forged stem portion 98. Alternatively, the stem die 82 can be generally cylindrical in shape, which is preferred if the stem portion 98 has not yet been forged.

In the method of the present invention for forging near net shaped teeth or a tooth arrangement on gears, and especially on pinion gears with helical angles, the grooves forged in the head portion 92 between the teeth 93 can allow or permit the first die 22 to contact or otherwise touch the second die 80, causing damage or even failure of the first and/or second dies 22 and 80. To assist in preventing or eliminating contact between the first and second dies 22 and 80, respectively, during the forging stroke, the top surface 83A of the stem die 82 can include a recess 83A provided around the outer portion of the top surface 83 which assists to form an annular shaped protrusion or lip 94 around the lower portion of head portion 92 during the forging stroke, as exemplified in FIG. 4B.

Returning now to FIG. 2, in accordance with the present invention, an axial restriction member 99 is provided to assist in removing the forged head portion 92 from the cavity 27 of tooth die 26. In one embodiment, a sufficient amount of resistance and/or surface friction between the surface 98A of stem portion 98 and the interior surface 85 of the stem die 82 can be provided so that axial movement of the forged gear 90 can be restricted substantially, yet the forged gear 90 can rotate or move in a radial direction so that the teeth 93 generally begin to unscrew or otherwise become disengaged from the tooth die 26, thus permitting the head portion 92 to disengage or become removed from the cavity 27 without nicking or otherwise damaging teeth 93. The resistance provided by in the present invention needs to be sufficient so that the stem portion 98 is not removed (e.g., lifted) from the stem cavity 84 as first and second dies (22 and 80) separate (see arrow "B").

A preferred embodiment of the axial restriction number 99 of the present invention includes one or more holding bands 89 or other suitable devices or configurations that can be provided in or along the interior surface 85 for assisting in substantially preventing or restricting axial movement of the forged gear 90 after the head portion 92 has been forged and as the first die 22 is retracting or otherwise moving away from second die 80. Yet the holding band 89 of the present invention allows or permits radial or rotational movement of the forged gear 90 while first die 22 is retracting. The holding band 89 can be a depression or other suitable indentation, dent, hollowed or roughened portion in or on interior surface 85 that extends around part of the interior surface 85, or can extend preferably 360 degrees around the interior surface 85. Alternatively, the holding band 89 can include a plurality of suitable depressions (not shown) provided in the interior surface 85. The holding band 89 only needs to be sufficiently deep and/or wide so that the resulting stem protrusion 98B on the stem portion 98 will assist in providing sufficient resistance and/or surface friction between the stem portion 98 and the interior surface 85 of the stem die 82. A depth into stem die 82 from about 0.01 to about 0.02 inches (0.254 mm to 0.508 mm) and a length (or width) along thee interior surface 85 from about 3.1 mm to about 12.7 mm can provide sufficient resistance and/or surface friction to assist in removing the head portion 92 from the cavity 27.

The holding band 89 preferably can be positioned adjacent or in close proximity to the transition area 81 where the diameter of interior surface 85 changes (e.g., near the interface of first and second portions 86 and 87). Although the holding band 89 can be positioned at any point along the longitudinal length of interior surface 85, it is even further preferred that the holding band 89 be provided in and around the portion of the interior surface 85 with the largest diameter (e.g., first portion 86) for maximizing resistance (e.g., surface friction) to effectively prevent axial movement of the stem portion 98 from stem die 82 as first die 20 retracts or moves away relative to second die 80.

In manufacturing a near net shaped gear 90, several pre-forging steps can be undertaken to provide a suitable solid preform 16, as exemplified in FIG. 6. Typically, gears manufactured by forging techniques and methods can be used in heavy duty automotive or industrial applications, and can be made from hot rolled or turned barstock raw material that can be either a ferrous or non-ferrous material. Preferably, the raw material may be a low to medium carbon level alloy steel having a carbon content from about 0.05% to about 0.5% or preferably from about 2% to about 4%. Illustrative examples of suitable materials used in the present invention include AISI (American Iron Steel Institute) 8620, 8625, 8822, or 4620.

From the raw materials, an individual solid workpiece, typically having generally a cylindrical shape, may be provided using techniques known in the industry, such as shearing or sawing. In the present invention, the volume of the solid workpiece should be selected properly, and can be cut to be approximately equal to the volume of the cavity 27 and stem cavity 84, including holding band 89 and recess 83A, since the present invention is preferably used in and involves a closed die forging operation.

The workpiece can be coated or soaked with a lubricant, such as graphite, which assists in enhancing the flow of metal along the surfaces of tooth die 26, stencil die 30 and stem cavity 84 (e.g., interior surface 85 and recess 83A), which in turn, assists in reducing the possibility that the forged gear 90 will seize to surfaces of the tooth die 26, stencil die 30, or stem cavity 84 after the forging stroke.

The solid workpiece may be forged using conventional forging techniques known to those skilled in the art initially to provide the stem portion 98, which is exemplified in FIG. 6. After forging the stem portion 98, the head portion 16A of preform 16 can be heated as quickly as practical to a temperature of at least about 1300° F. (700° C.), and preferably from about 1600° F. to about 2000° F. (850°–1100° C.), to take advantage of, or enhance, the improved ductability and formability of the metal at increased temperatures, and so that the preform 16 is sufficiently malleable. In another embodiment, the entire workpiece (i.e., both the head and stem portions) can be heated concurrently, and can be forged in the same die apparatus or press machine (e.g., 20) in sequence, thus effectively eliminating the need for heating one end (e.g., the head portion 16A) between the forging strokes.

The forming or forging of a near net shaped gear 90 in accordance with the present invention can be accomplished with the single stroke of machine press 20, thus effectively reducing the time consuming and expensive precision machining operations. The present invention can place or position the preform 16, similar to the one exemplified in FIG. 6, between first and second dies (e.g., 22 and 80) via inserting the stem portion 98 in the stem cavity 84. A lubricant can be sprayed into the stem cavity 84 of stem die 82 and the negative cavity 27 of the tooth die 26 before the forging stroke to help prevent the gear 90 from seizing or otherwise bonding to the interior surface 85 of stem cavity 84 and forging surface 28A.

Figure 3:
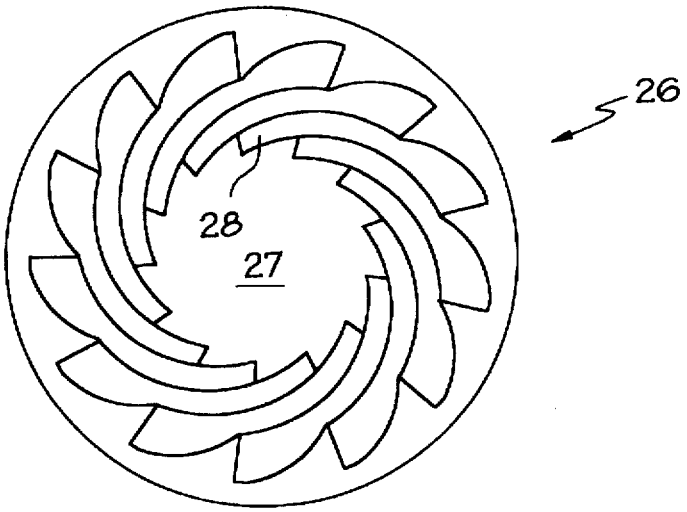
FIG. 3 is a bottom view of a tooth die having a near net shaped cavity of a gear.
Figure 4A:
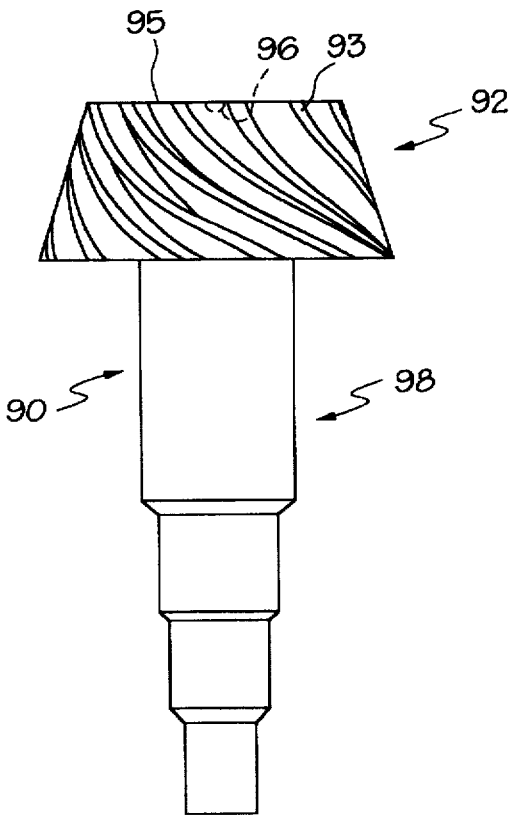
FIG. 4A is a perspective view of one embodiment for a forged near net shaped pinion gear.
Figure 4B:
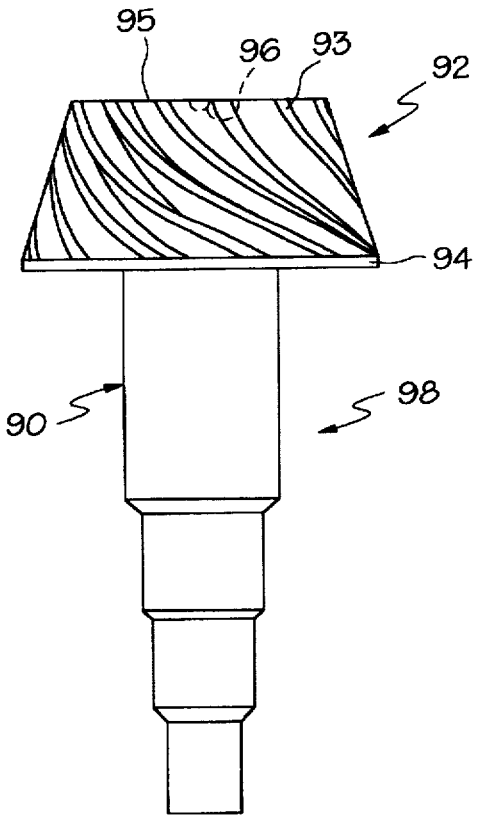
FIG. 4B is a perspective view of a second embodiment of a forged near net shaped pinion gear.

While the first die 22 generally can be forced toward second die 80 in an axial direction, and preferably in a downward vertical direction, as indicated by arrow "A," the material of head portion 16A can be pressed into the cavity 27, exemplified in FIG. 3, to form or forge the head portion 92 of a near net shaped gear 90 having generally the desired arrangement of teeth or tooth configuration, which is exemplified in FIGS. 4A and 4B.

The press machine or die apparatus 20 selectively applies a sufficient amount for force, such as from about 500 to about 3000 tons ($4.5\times10^6$ to $2.7\times10^7$N) to the head portion 16A in a single stroke to forge or otherwise form the head portion 92, as exemplified in FIGS. 4A–4B. As first die 22 forges or otherwise forms the head portion 92, some material of stem portion 98 "sweats" or otherwise flows into the holding band 89 forming a stem protrusion 98B.

The left side of FIG. 2 exemplifies the press machine or die apparatus 20 in a closed position after the completion of the forging portion of the stroke to form or otherwise manufacture the head portion 92 of the forged gear 90. Subsequently, the first die 22 can be selectively retracted or moved away from the forged gear 90 relative to the second die 80, preferably moving axially upwardly away from the second die 80, as shown by arrow "B," and which is exemplified by the right side of FIG. 2.

As first die 22 retracts or moves away from second die 80 (see arrow "B" in FIG. 2), the axial restriction member 99 restricts substantial axial movement of the forged gear 90, yet it permits radial or rotational movement of the forged gear 90, by which the teeth 93 generally can unscrew or become disengaged with the teeth 28 of tooth die 26.

After the head portion 92 has disengaged or otherwise been removed from the tooth die 26, an ejector rod (not shown) can assist in removing or ejecting the stem portion 98 from stem cavity 84. The stem protrusion 98B should have a sufficiently narrow width and depth so that the ejection rod can effectively "size" or otherwise remove stem protrusion 98B as the stem portion 98 is being removed (e.g., ejected) from the stem die 84. If the surface of the resulting stem portion 98 is not sufficiently smooth after it has been "sized," it is contemplated that this surface portion could be further machined, as desired or needed.

The lip 94 can be machined off the head portion 92 or otherwise removed using, for example, a lathe, and the surface of the forged gear 90, including both the head portion 92 and/or stem portion 98, can be polished or otherwise finished using techniques and equipment standard in the industry.

Figure 5:
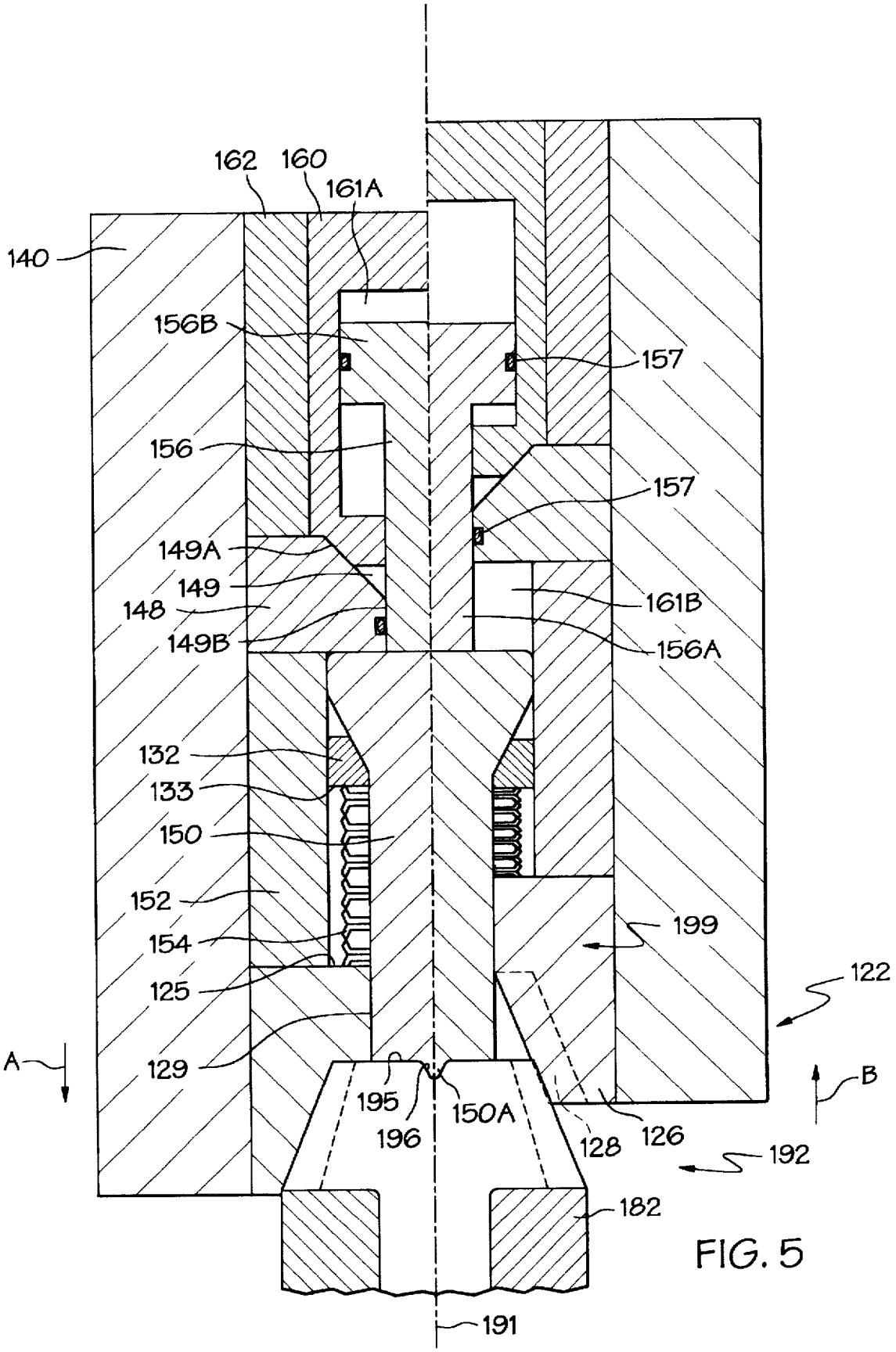
FIG. 5 is a partial cross sectional view of a die apparatus incorporating an alternative embodiment of the present invention wherein the left side illustrates the die apparatus in a closed position and the right side illustrates the die apparatus in an open position.

An alternative embodiment of the present invention for manufacturing or forming (i.e., forging) the near net shaped head portion of pinion gear is exemplified in FIG. 5, and includes features and elements which are substantially identical to corresponding features and elements in FIGS. 1 through 4B and 6. These substantially identical elements and features are designated using a three-digit reference number in which the last two digits correspond to the reference number used in FIGS. 1 through 4B and 6. Accordingly, the discussion of press machine or die apparatus 120 does not contain a redundant description of elements and features identical to or similar to the elements exemplified in FIGS. 1 through 4B and 6.

Axial restriction member 199 is located or positioned in the first die 122 where the head portion 192 of the gear 190 can be also removed or otherwise disengaged from the tooth die 126 by substantially restricting the axial movement of forged gear 190 while permitting or allowing it to move in a radial or rotational direction.

First die 122 can include a tooth die 126 generally centered on center axis 191 having one or more tooth segments 128. The tooth die 126 can also include a centered bore hole 129 therethrough that can be configured to allow or permit the distal portion of a pin 150, that also can be centered on center axis 191, selectively to slide through the centered bore hole 129. The pin 150 may be generally "T-shaped" and can have a cylindrical shaped distal end and preferably also can have a drive lug or male center 150(*a*) to assist in forging a notch or female center 196 on the top surface 195 of the head portion 192. A guide ring 152 is illustrated as being positioned above tooth die 126 and around pin 150 to help in maintaining the pin 150 along the center axis 191 of gear 190.

Positioned between guide ring 152 and pin 150, and above tooth die 126 may be one or more springs 154, preferably belleville springs, which can register against the top surface 125 of tooth die 126 and the bottom surface 133 of a ring shaped backing die 132. The fit relationship of the backing die 132 and proximal portion of the pin 150 can be configured to assist in preventing the backing die 132 from moving axially relative to the pin 150 during the retraction stroke of tooth die 126, as exemplified on the right side of FIG. 5 by arrow "B."

Positioned above guide ring 152 and pin 150 may be a ring shaped pin support die 148, with an inner bore hole 149 that includes a tapered portion 149A and a non-tapered portion 149B, the non-tapered portion 149B being sized and configured to allow the distal portion 156A of a piston rod 156 to slide back and forth through the tapered portion 149A. Hydraulic seals 157, such as O-rings, may be provided around the non-tapered portion 149B effectively to isolate the first portion 161B of chamber 161 in the cylinder 160, and around the proximal portion 156B of the piston rod 156 to thereby effectively hydraulically isolate the first and second portions 161A and 161B, respectively, of the chamber 161.

An annular or ring-shaped die holder 140 is exemplified as assisting in supporting tooth die 126, guide ring 152, and pin support die 148. Although cylinder 160 is exemplified in FIG. 5 as an integral structure, it is contemplated that cylinder 160 could comprise a plurality of individual parts or components connected or joined. Positioned around the cylinder 160 can be a cylinder housing 162 for assisting in carrying the forging load through the first die 122, and more specifically, through the ring shaped pin support die 148 and guide ring 152 to the tooth die 126. The cylinder housing 162 can also help reduce the effect that the forging load can have on the operations of the cylinder 160 and its chamber 161, piston rod 156, and on the operations of the pin 150.

During the forging portion of the stroke, exemplified by arrow "A" in FIG. 5, the first portion 161B of the chamber 161 selectively can be pressurized sufficiently and the second portion 161 A of chamber 161 selectively can be vented sufficiently so that the pin 150 may be positioned in a retracted forging position, as exemplified on the left side of FIG. 5.

As the first die 122 begins to retract or move away from relative to the second die 180, as exemplified by the right side of FIG. 5, the axial restriction member 199 assists in substantially preventing the axial movement of the forged gear 190. The previously vented second portion 161A selectively can be pressurized sufficiently and the first portion 161B selectively may be vented sufficiently so that the piston rod 156 can maintain its axial position pressed against or otherwise engaging the top surface of the pin 150, and preferably, the male center 150A remains positioned in the female center 196. As the tooth die 126 retracts relative to the second die 180, the hydraulic pressure in the second chamber 161A selectively can be sufficient to overcome the force of springs 154 to help maintain the axial position of the piston rod 156 so that the pin 150 can remain in engagement with or pressed against the top surface 195 of the head portion 192. As the tooth die 126 and other portions of the first die 122 retract or move away relative to the second die 180, the forged gear 190 can be restricted or otherwise prohibited from moving axially, however, the stem portion 198 of the gear 190 may be permitted to rotate in stem die 182 so that the head portion 192 can be removed from the tooth die 126 without nicking or otherwise damaging the teeth 193 on the forged head portion 192.

Alternatively, a holding band, (e.g., 89 in FIG. 2) can also be provided in stem die 182 to further assist in removing the head portion 192 from tooth die 126.

Having shown and described the preferred embodiments to the present invention, further adaptions of the apparatus and method forging a gear as described herein can be accomplished by appropriate modifications by one of ordinary skill in the industry without departing from the scope of the invention. For example, the present invention has been described having a first die 22 in motion while the second die 80 remains stationary. It is contemplated that the present invention can include a second die 80 that is in motion while the first die 22 remains stationary. Furthermore, the present invention can be used to forge various types of gears, such as ring gears or pinion gears. Although the previous discussion requires that the stem portion 98 of the billet be forged first, it is contemplated that the head portion 16A of the preform 16 can be forged to provide head portion 92 prior to forging of the stem portion 98, or that forging of both the head portion and stem portion 98 of the preform billet can be accomplished on the same die apparatus. Other potential modifications will be apparent to those skilled in the art. Accordingly, the scope of the present invention should be considered in terms of the following claims and is understood not be limited in the details, structure and operations shown as described in the specification and drawings.

What is claimed is:

1. An improved die apparatus for forging a solid workpiece having a head portion and a stem portion into a forged gear having a near net shaped head portion, said die apparatus comprising:

(a) a first die and a second die, the first and second dies being selectively moveable relative to each other, the first die having a tooth die with a negative cavity therein corresponding to the near net shaped head portion to forge the head portion; and (b) an axial restriction member provided in at least one of the first and second dies, for removing the near net shaped head portion from the negative cavity as the first die moves away from relative to the second die, wherein the axial restriction member restricts axial movement of the forged head portion and permits radial movement of the forged head portion as the first die moves away from relative to the second die.

2. The die apparatus of claim 1, wherein the second die comprises a stem die having an interior surface, the stem die is configured to receive the stem portion of the solid workpiece, the stem portion having a surface, the axial restriction member comprises a structure configured in the interior surface for providing axial resistance between the surface of the stem portion and the interior surface.

3. The die apparatus of claim 1, wherein said axial restriction member is provided in said first die.

4. The die apparatus of claim 1 wherein said axial restriction member is located in said first and said second dies.

5. The die apparatus of claim 2, wherein said axial restriction member comprises a holding band that includes a depression formed in said interior surface for forming a stem protrusion on said surface of said stem portion.

6. The die apparatus of claim 5, wherein said depression extends substantially around the entire periphery of said interior surface.

7. The die apparatus of claim 5, wherein said holding band includes at least two depressions formed in said interior surface.

8. The die apparatus of claim 5, said depression having a depth from about 0.01 inches to about 0.02 inches.

9. The die apparatus of claim 5, wherein said stem die has a plurality of portions, each of said portions having a different effective outer diameter, and said holding band is provided in the portion with the largest effective outer diameter.

10. The die apparatus of claim 5, further comprising a means for removing said stem protrusion.

11. The die apparatus of claim 3, wherein said first die has a tooth die with a bore hole, and a pin slidably receivable through said bore hole, said pin being selectively extendable through said bore hole to maintain engagement substantially against said near net shaped head portion as said tooth die moves away from relative to said second die.

12. An improved method for producing a forged gear having a near net shaped head portion and a stem portion from a solid workpiece, comprising the steps of:

(a) providing a press machine having a second die for receiving the stem portion;

(b) inserting the stem portion into the second die;

(c) forging the head portion of the solid workpiece with said press machine into the near net shaped configuration; and (d) restricting axial movement of the forged gear while permitting radial movement of the forged gear;

e) removing the forged head portion from the press machine before removing the stem portion from the second die.

13. The method of claim 12, comprising the step of restricting axial movement of said forged gear while permitting radial movement of said forged gear while said dies are separating relative to each other.

14. The method of claim 12, further comprising the steps of:

(d) providing a press machine having a first die and a second die; and (e) applying a resistance to said stem portion of said forged gear to restrict axial movement of said forged gear while permitting rotational movement of said forged gear.

15. The method of claim 12, comprising the steps of:

providing a stem protrusion on the stem portion;

removing the stem protrusion on the stem portion.

16. The method of claim 15, wherein the method of removing the stem protrusion comprising removing the stem protrusion during removal of the stem portion from the second die.

17. The method of claim 12, comprising the steps of:

(d) providing a press machine having a first die and a second die, the first die including a tooth die with a bore hole, and a pin selectively slidably extendable through the bore hole;

(e) engaging the pin against the head portion of the forged gear; and (f) moving the tooth die away from the forged gear relative to the second die.

18. The method of claim 15, wherein the method of providing a stem protrusion comprising providing a stem protrusion while the head portion of the solid workpiece is being forged.

19. An improved method for producing a forged gear having a near net shaped head portion and a stem portion from a solid workpiece, comprising the steps of:

(a) providing a die apparatus having a first die and a second die, the second die having a stem die with a holding band provided in the interior surface of the stem die;

(b) inserting the stem portion into the second die;

(c) forging the near net shaped head portion of the workpiece with the die apparatus;

(d) forging a stem protrusion on the stem portion; and (e) removing the near net shaped head portion from the die apparatus before removing the stem portion from the second die.

20. The method of claim 19, comprising the step of substantially restricting axial movement of said forged gear while permitting radial movement of said forged gear.

21. The method of claim 19, comprising the step of ejecting the forged gear from the second gear.

22. The method of claim 19, comprising the step of removing the stem protrusion from the stem portion.

23. The method of claim 21, comprising the step of removing the stem protrusion while ejecting the forged gear.

* * * * *